US006494632B2

(12) United States Patent
Cappello et al.

(10) Patent No.: US 6,494,632 B2
(45) Date of Patent: Dec. 17, 2002

(54) PRINTER OPERABLE FROM A FRONT SIDE AND STACKABLE WITH OTHER EQUIPMENT

(75) Inventors: Paolo Cappello, Mongrando (IT); Piero Salussolia, Alice Castello (IT)

(73) Assignee: Olivetti Tecnost S.p.A., Turin (IT)

( * ) Notice: Subject to any disclaimer, the term of this patent is extended or adjusted under 35 U.S.C. 154(b) by 156 days.

(21) Appl. No.: 09/739,261

(22) Filed: Dec. 19, 2000

(65) Prior Publication Data

US 2001/0017644 A1 Aug. 30, 2001

(30) Foreign Application Priority Data

Dec. 20, 1999 (IT) ..... TO99A1118

(51) Int. Cl.[7] ..... B41J 11/58
(52) U.S. Cl. ..... 400/624; 400/625; 400/691
(58) Field of Search ..... 400/624, 625, 400/691, 692, 693; 271/145, 3.14; 700/691, 692, 693

(56) References Cited

U.S. PATENT DOCUMENTS

| | | | | |
|---|---|---|---|---|
| 5,213,426 A | | 5/1993 | Ewing | |
| 5,248,207 A | | 9/1993 | Yamamoto et al. | |
| 5,746,528 A | | 5/1998 | Mayer et al. | |
| 6,012,810 A | | 1/2000 | Ohashi | 347/104 |
| 6,120,201 A | * | 9/2000 | McKay et al. | 400/691 |

FOREIGN PATENT DOCUMENTS

EP 0 879 706 A2 11/1998

* cited by examiner

*Primary Examiner*—Andrew H. Hirshfeld
*Assistant Examiner*—Minh H. Chau
(74) *Attorney, Agent, or Firm*—Banner & Witcoff, Ltd.

(57) ABSTRACT

A parallelepiped shape printer (20) suitable being stacked with equipment, comprising a fixed structure (65) upon which an outer casing (22) of the printer is mounted; a movable cassette (21) bearing a printing assembly (33); and a feeding tray (34) which contains a ream (36) of sheets of paper (37), wherein the cassette (21) may be manually extracted from and inserted in the outer casing (22) through a front side (23) of the printer (20). A feeding and guiding mechanism (81), comprising a pair of rods (82) and two inclining ramps (87) integral with the fixed structure (65), cinematically connects the feeding tray (34) with the cassette (21), and sees to it that, when the latter is manually extracted from the casing (22), the feeding tray (34) is automatically dragged by the cassette (21) to move automatically from a working position (P1) inside the casing (22), wherein the feeding tray (34) is suitable for cooperating with the cassette (21) for feeding the sheets (37) to the printing assembly (33), to an access position (P2), wherein the feeding tray (34) is accessible to the user in the area of the front side (23) of the printer; and also sees to it that, when the cassette (21) is subsequently reinserted in the casing (22), the feeding tray (34) automatically returns to its working position.

19 Claims, 6 Drawing Sheets

PRINTER OPERABLE FROM A FRONT SIDE AND STACKABLE WITH OTHER EQUIPMENT

FIELD OF THE INVENTION

This invention relates to a printer operable from a front side and suitable for being stacked with other equipment.

A printer of this type is provided for printing black and/or colour images on a printing medium, such as a sheet of paper, by way of a known printing technique, for example through successive scanning movements of an ink jet printhead in front of the print medium; and is built in such a way that manual members for printer driving, the compartment accommodating the printhead and from which the latter must be removed when being replaced, the tray containing the blank sheets still to be printed, and the tray collecting the printed sheets, are all accessible from a unique front side of the printer facing the printer operator.

In addition the printer normally has an outer casing with a shape very similar to a parallelepiped, with two lateral sides, a substantially flat upper and lower side without any members for working on the printer, in such a way that the latter may easily be stacked, above or below, with other equipment.

BACKGROUND OF THE INVENTION AND STATE OF THE ART

Stackable printers having the characteristics described above have been developed primarily to satisfy the widespread requirement among users for printers that take up little space and are easily placed in any area in the work place or the home.

Generally these printers are stacked and connected, so as not to occupy additional plan space, with equipment for the reproduction of sounds and images provided with a display screen, such as for example a television, either alone or associated with a video recorder, or a terminal connected to a network, for the purpose of printing constantly on a sheet of paper the alphanumeric information and images displayed on the screens of these equipment items.

Within the framework of this use, these printers as well as being stackable must also allow their power and connection cables to be arranged compatibly with those of the adjacent equipment and, for reasons of appearance, preferably on the side hidden from view.

A printer stackable with other equipment and operable from a front side solely for the purpose of satisfying, at least partially, the requirements outlined above is known from the European patent application EP 0879706.

This printer comprises an outer parallelepiped shape casing, a printing unit provided with a printhead, and a feeding cassette intended for accommodating a ream of sheets to be fed to the printing unit, wherein both the printing unit and the feeding cassette can be extracted from and inserted in the outer casing through a front side of the printer for effecting the usual maintenance operations, such as for example replacement of the printhead and loading the feeding cassette with a new ream of paper.

The printer also comprises a raising or lowering device, which may be actuated manually by means of an appropriate slider located on the front side for disposing the feeding cassette in alignment with the printing unit, after the feeding cassette has been inserted in the outer casing, so as to allow a correct feeding of the sheets from the feeding cassette to the printing unit.

The same device, when it is actuated in the opposite direction, moves the feeding cassette laterally with respect to the printing unit, in order to allow removal of the feeding cassette through the front side.

This printer is on the whole fairly complicated to use in order to perform the usual maintenance operations, and most particularly, when having to intervene on either the printing unit or on the feeding cassette, it implies, in addition to extracting the printing unit from the casing, the manual operation of actuating the slider located on the front side of the printer to command the device for raising/lowering the feeding cassette.

SUMMARY OF THE INVENTION

The object of this invention is therefore to produce a printer which is capable of satisfying all the requirements referred to in the foregoing, simply and inexpensively, and which, while using the tried and tested concept of being stackable with other equipment and of being operable from a front side only, still represents a significant improvement with respect to the solutions known today, and in particular is easier to use.

In greater detail, the printer of the invention must allow the operator comfortable access to all the controls and all the functions of the printer from its front side, and also have a shape, an appearance, operating methods and dimensions compatible with equipment for the reproduction of sound and images overlaid on the printer in the style of a column.

In addition, it must be possible to arrange the printer's electric power and connection cables in accordance with those of the other overlying equipment, without detriment to general aesthetics.

A further object of the invention is to produce a printer that may be inserted in a compartment of a cabinet having closed sides and of width just sufficient for insertion of the printer.

The above objects have been obtained by means of a printer stackable and operable from the front, having the characteristics defined in the main claim.

In particular, in the printer according to this invention the upper side, the lower side and the two lateral sides, being bereft of functions or controls, can be made in the shape of flat walls which permit the printer to be overlaid in a column with other equipment, and also to be placed in a compartment of a cabinet closed at the sides and being just wide enough to allow insertion of the printer, without for this compromising its operation in any way.

BRIEF DESCRIPTION OF THE DRAWINGS

These and other objects, characteristics and advantages of the invention will become apparent from the following description of a preferred embodiment, provided by way of non-restricting example, with reference to the accompanying diagrams in which.

DESCRIPTION OF A PREFERRED EMBODIMENT OF THE INVENTION

Figure 1:
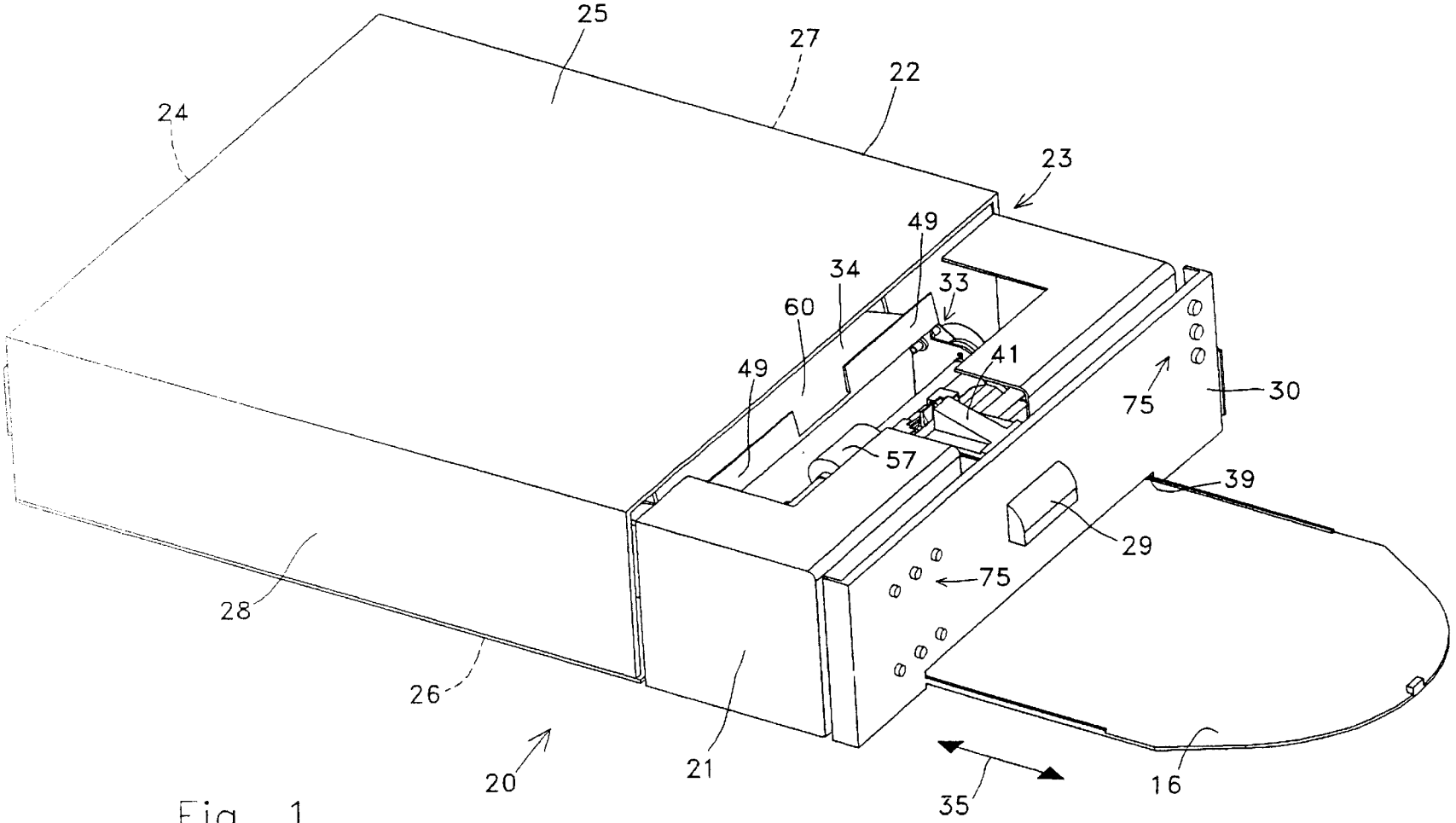
FIG. 1 is a first front partial perspective view from the left of a printer according to this invention operable from the front and stackable with other equipment.

FIG. 1 depicts in perspective from a front zone a printer according to this invention and suitable for being stacked with other equipment. The printer is generically indicated with the numeral 20 and comprises an outer casing 22, and a cassette 21, also called print cassette in the following, which is mounted slidingly with respect to the casing 22 so as to be able to be extracted from and later re-inserted in this casing 22.

In particular in FIG. 1 the printer 20 is represented in an open configuration in which the print cassette 21 is partially extracted from the outer casing 22.

The outer casing 22 has a substantially parallelepiped shape defining a rear side 24, an upper side 25, a lower side 26, a right side 27, and a left side 28, and is open to the front, in correspondence with a front side 23 of the printer 20, to permit extraction of the print cassette 21 and its subsequent reinsertion with respect to the casing 22, as will be described more fully in the following.

The print cassette 21 has a front wall 30, which is arranged in correspondence with the front side 23 of the printer 20 and is provided with a handle 29 which can be actuated manually so as to slide the print cassette 21 in both directions with respect to the casing 22, as indicated by the arrows 35.

The front wall 30 also has a lower edge which forms a recess 39 through which the sheets of paper printed by the printer 20 exit.

Optionally a collection support 16 may be externally connected to the print cassette 21 for receiving the printed sheets coming from the recess 39.

The printer 20 is also equipped with known command and control members generically designated with the numeral 75, of the buttons and luminous lamps type, for example, which are preferably arranged on the outside of the printer 20 along the front wall 30, as shown by way of example in FIG. 1.

These control and command members are provided respectively for indicating operating status of the printer 20 and for being actuated manually by an operator for the purpose of activating the printer 20.

The controls for activation of the printer 20 may also be of a type other than the typically manual ones mentioned above, and be produced for example through a remote control device suitable for transmitting to an appropriate receiving member incorporated in the printer 20 a given signal for activating the printer 20, according to widely known techniques.

Figure 5:
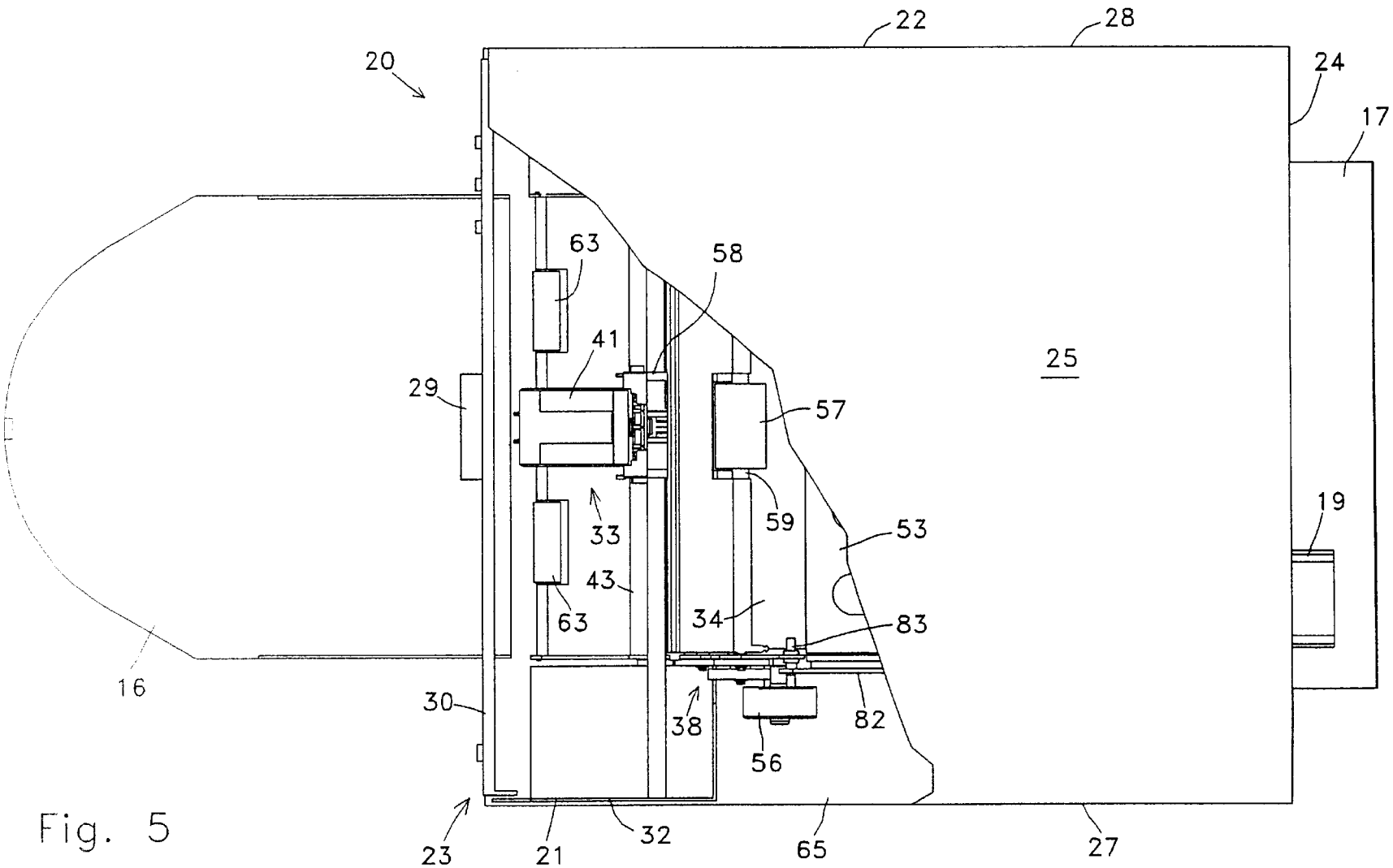
FIG. 5 is a plan view of the printer of FIG. 1 with its casing partially removed.
Figure 6:
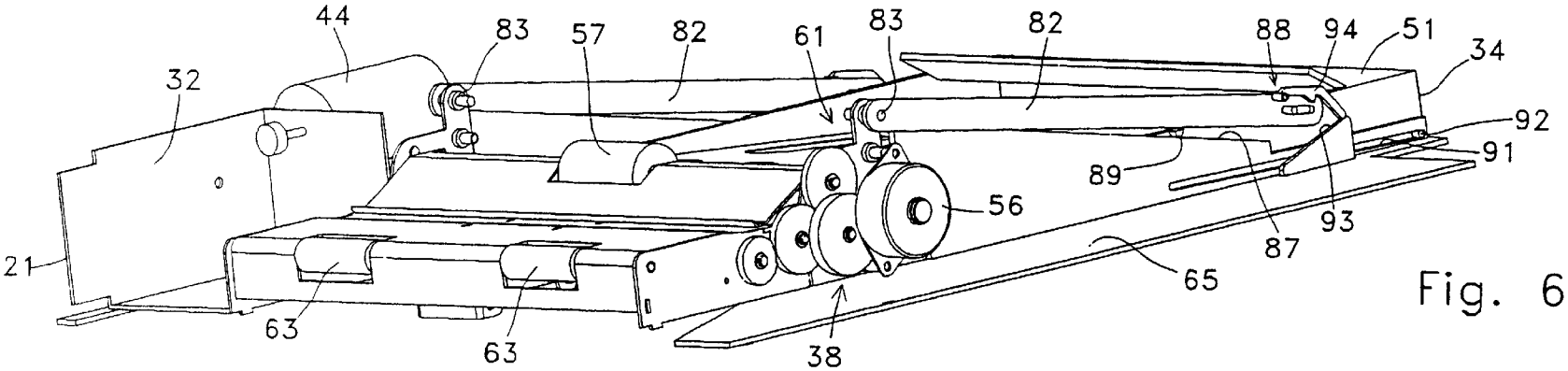
FIG. 6 is a third partial perspective view, concerning an inner portion of the printer of FIG. 1 and portraying a feeding mechanism for feeding the sheets through the printer.

The various cables for electric power supply of the printer 20 and its interconnection with the external equipment are physically connected to the printer 20 through the rear side 24 of the casing 22. In particular it is along the rear side 24 that the connectors for the various cables are arranged, among which for example a SCART type socket 19, represented schematically in FIG. 5, to allow the connection of the printer 20 to an ordinary television.

Figure 2:
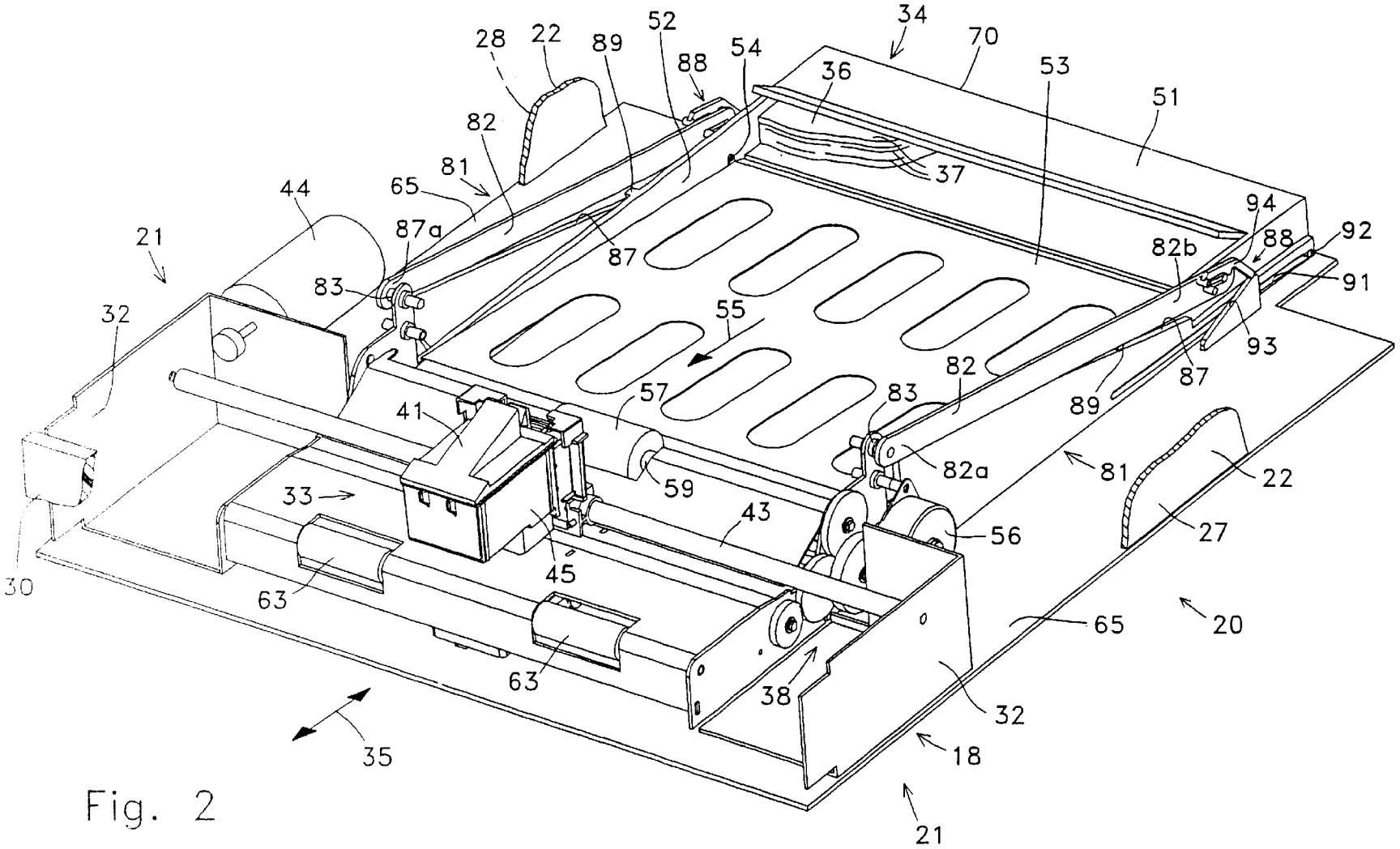
FIG. 2 is a second front perspective view from the right of the inner structure of the printer of FIG. 1, and in particular of a print cassette that can be extracted from and inserted in an outer casing of this printer.
Figure 3:
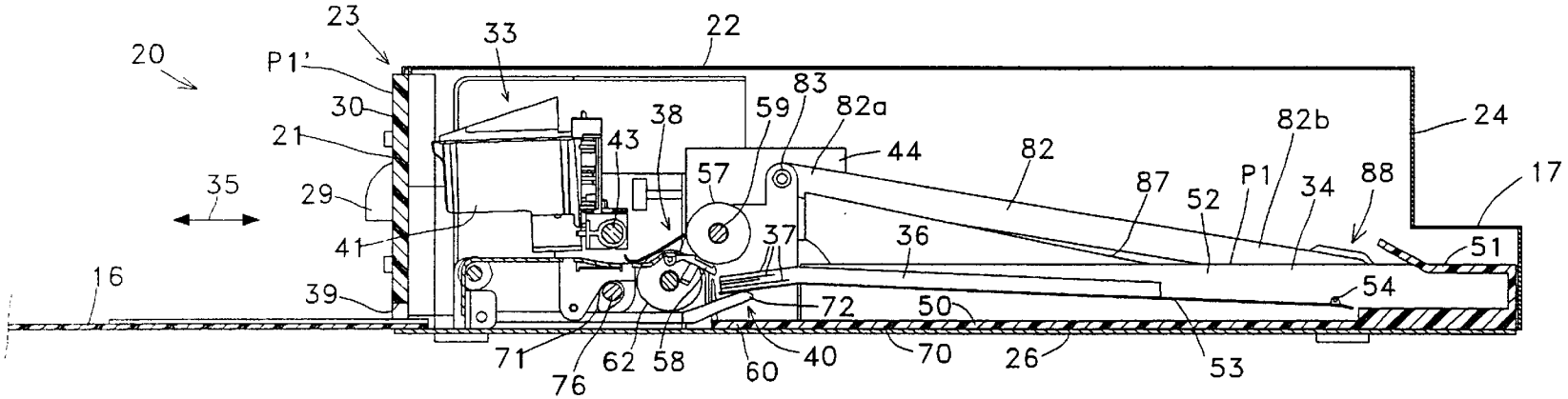
FIG. 3 is a longitudinal section of the printer of FIG. 1, in a closed configuration with the print cassette of FIG. 2 fully inserted in the printer casing.
Figure 4:
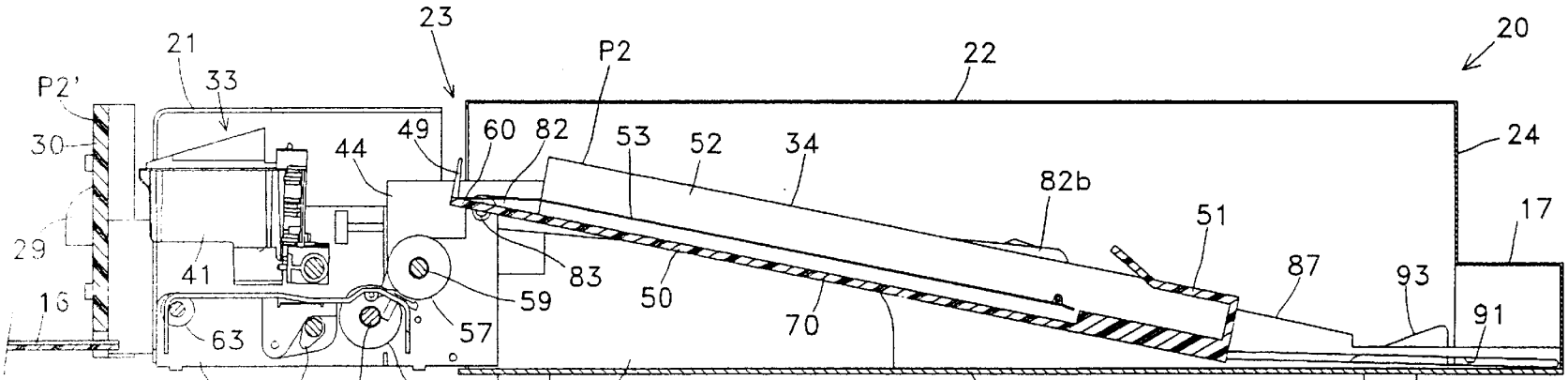
FIG. 4 is a longitudinal section of the printer of FIG. 1, with the print cassette of FIG. 2 extracted from the printer casing.

FIGS. 2–4 depict in detail the internal parts of the printer 10, and in particular an inner fixed structure 65 on which the outer casing 22 is integrally mounted, and a mobile structure 32 of the print cassette 21 which bears not only the front wall 30 but also the internal mechanisms of the print cassette 21.

To allow the extraction and reinsertion of the print cassette 21 with respect to the casing 22, the mobile structure 32 is mounted slidingly on linear ways, generically designated with the numeral 18, which are made on the fixed structure 65 and which extend substantially parallel to the development in the longitudinal direction of the casing 22.

In this way, the extraction and reinsertion movement of the print cassette 21, along the direction defined by the arrows 35, takes place parallel to the lateral sides 27, 28 and to the top side 25 and bottom side 26 of the casing 22.

The printer 20 further comprises a printing assembly 33 which is integral with the print cassette 21 and which is therefore adapted for moving together with the latter with respect to the casing 22; a feeding tray 34 disposed inside the casing 22 and adapted for accommodating a ream 36 of sheets of paper 37 to be fed to the printing assembly 33; a feeding mechanism 38, borne by the print cassette 21, suitable for feeding along a given path the sheets 37 from the feeding tray 34 to the printing assembly 33 and for expelling them out of the printer 20, through the recess 39 formed by the front wall 30, after the sheets 37 have been printed by the printing assembly 33; and a lifting mechanism 40 (FIG. 3) adapted for periodically lifting the ream 36 accommodated in the feeding tray 34 in order to bring an upper sheet 37 arranged at the top of the ream 36 to cooperate in contact with the feeding mechanism 38, so that it is taken and fed to the printing assembly 33.

The printer 20 can operate according to any known printing technology, and will thus be described, merely by way of non-limiting example, with reference to the ink jet technology.

It is stressed, moreover, that the concept behind this invention is applicable on a printer operating with any printing technique, and may therefore be considered as independent of the specific printing technology adopted.

As the construction and general mode of operation of a printer based on the ink jet technology are already so widely known in the sector art, a full description will not be provided here, the account being limited to only those characteristics of relevance for the purposes of understanding this invention.

In detail, with reference to FIG. 2, the printing assembly 33 comprises an ink jet printhead 41, which is removably housed in a carriage 45, which is in turn slidingly mounted on a guide 43 and is connected to a feed motor 44 through known joining members, consisting for instance of a belt, which for simplicity's sake are not depicted in the drawings.

The feed motor 44 is attached integrally to the structure 32 and has the function of commanding an alternating translating movement of the carriage 45 and therefore also of the printhead 41.

In practice, while the print carriage 45 translates backwards and forwards along a line of print, the printhead 41 borne by the carriage 45 ejects droplets of ink on the sheets 37 taken from the tray 34; and furthermore the sheets 37 proceed in front of the printhead 41 in a direction perpendicular to its backward and forward translating motion imparted by the carriage 45, according to a discrete line feed motion between one stroke and the next of said translating motion.

In this way the droplets ejected by the printhead 41 in accordance with a predetermined succession controlled by the control unit which controls the printer 20 impress a series of alphanumeric characters on the sheets 37.

The feeding tray 34 is made of an outer shell 70 which forms at a rear end of the feeding tray 34 a seat 51, closed at the bottom and on the four sides, adapted for receiving a rear portion of the ream 36 when it is accommodated in the tray 34; and a movable flat bottom 53 which is hinge-mounted on the seat 51 local to a fulcrum 54 and which bears at the bottom the remaining part of the ream 36 not accommodated in the seat 51.

As will be better described below, the feeding tray 34 is connected to the print cassette 21 so as to move together with the latter; in particular, when the print cassette 21 is fully inserted in the casing 22, the seat 51 of the feeding tray 34 is received by a protruding chamber 17 made along the rear side 24 of the casing 22.

The shell 70 of the feeding tray 34 comprises, as well as the seat 51, two lateral walls 52 which laterally retain the ream 36, when it is accommodated in the tray 34; and a lower wall 50 (FIGS. 3 and 4) which defines, in an area opposite the seat 51, a front end 60 of the feeding tray 34. The front portion 60 is adapted for supporting and retaining a corresponding front portion of the ream 36, and for this purpose is provided with two protrusions 49 (FIG. 1).

The flat bottom 53 is suitable for oscillating about the fulcrum 54 under the control of the lifting mechanism 40 to bring, on each cycle for the feeding of a new sheet 37, the ream 36 into contact with the feeding mechanism 38, as will be better described in the following.

Figure 7:
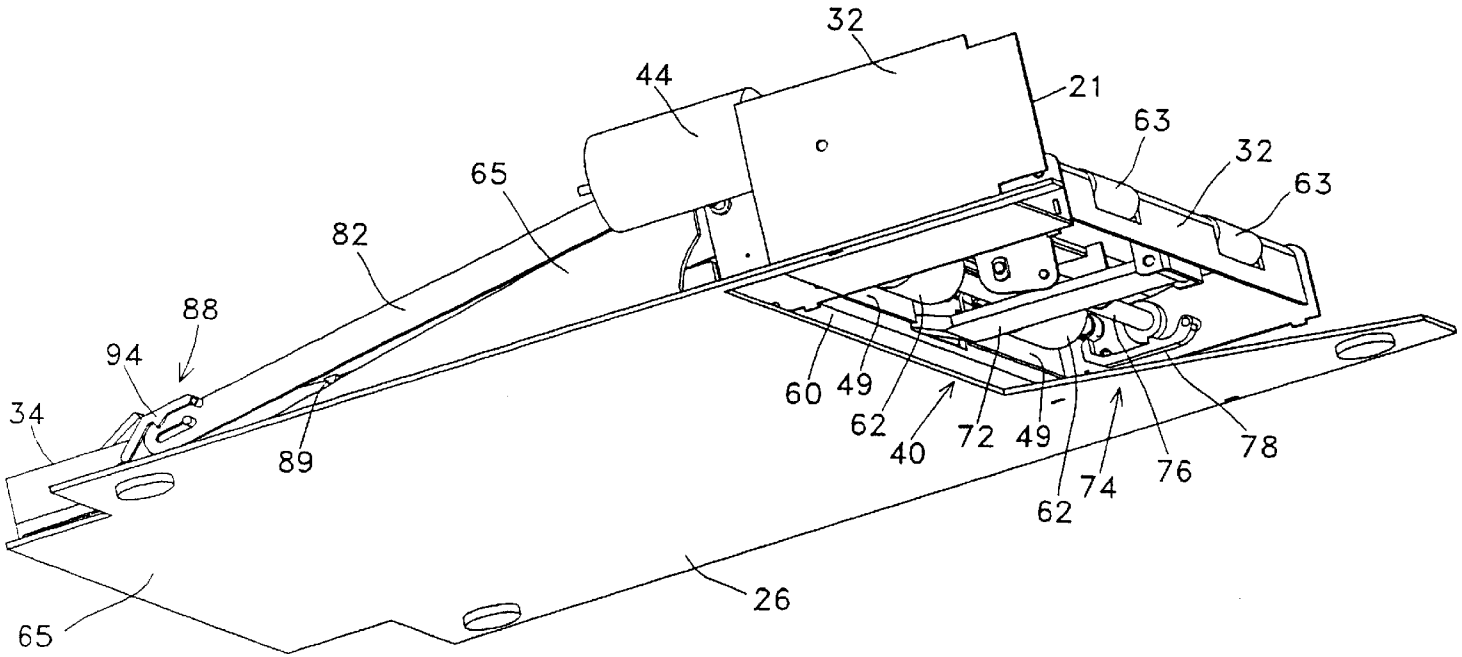
FIG. 7 is a fourth perspective view from below, relative to the same inner portion of the printer of FIG. 6, which depicts a lifting mechanism associated with the feeding mechanism.
Figure 8:
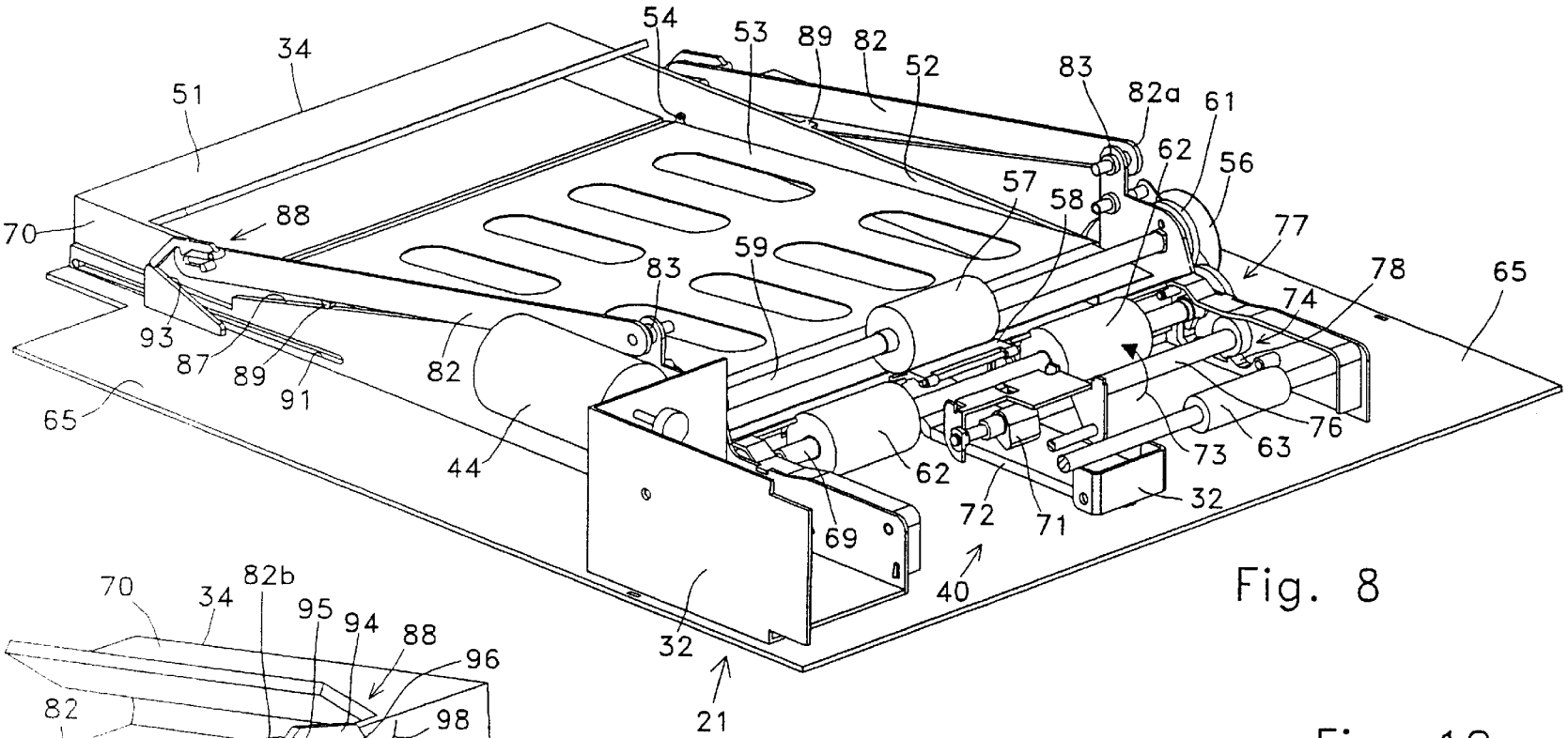
FIG. 8 is a fifth perspective view from the top of the lifting mechanism of FIG. 7.

The lifting mechanism 40 is suitable for being controlled by a main motor 56, and comprises, as can be seen in FIGS. 7 and 8, a cam 71 integrally mounted on a shaft 76; a cinematic chain which joins the shaft 76 to the motor 56 and which includes a clutching group 74; and a lifting lever 72 hinge-mounted at one end of the structure 32 of the cassette 21.

The lifting lever 72 is suitable for being rotated by the cam 71 and has one end, opposite that hinge-mounted on the structure 32, which extends between the two protrusions 49 of the front end 60 of the shell 70 for cooperating with a front edge of the flat bottom 53.

A spring not depicted in the drawings acts on the lifting lever 72 in such a way as to rotate it constantly upwards, so that it cooperates with the flat bottom 53 thus tending to bring the ream 36, lying on the flat bottom 53, into contact with the feeding mechanism 38.

The clutching group 74 is connected to the motor 56 through a gear train, generically designated with the numeral 77, arranged along one side of the structure 32 of the print cassette 21, and performs the function of producing, on each cycle for the feeding of a sheet 37 to the printing assembly 33, the connection of the shaft 76, which is initially motionless, to the motor 56, in response to an inversion of the direction of rotation of the motor 56 with respect to that which produces, through the feeding mechanism 38, a feeding of the sheets 37 to the printing assembly 33.

In this way, as will be better described in the following, the motor 56, when it subsequently inverts its direction of rotation and goes back to rotating according to the direction of rotation corresponding to the feeding of the sheets 37 to the printing assembly 33, commands the shaft 76 so as to rotate the cam 71 and correspondingly lift the flat bottom 53 in order to bring the uppermost sheet 37 of the ream 36 into contact with a separating roller 57, so that the latter, by rotating, separates it from the other sheets of the ream 36 and feeds it to the printing assembly 33.

Furthermore the clutching group 74 performs the function, on conclusion of the above-mentioned rotation of the cam 71, this rotation corresponding to roughly one revolution, of disconnecting the shaft 76 from the motor 56, so that both the shaft 76 and the cam 71 stop, and get ready for the next cycle for the feeding of a new sheet.

In particular, when the shaft 76 is commanded by a rotation of the motor 56 corresponding to feeding of the sheets 37 towards the printing assembly 33, the cam 71 and the shaft 76 turn in the counter-clockwise direction to produce the rotation of the lever 72 and the engagement of the ream 36 with the feeding mechanism 38, as indicated by the arrow 73 of FIG. 8.

The clutching group 74 is of the mechanical type, typically based on a pawl 78 and on a monodirectional rotating coupling, and will not be described in detail because it is made according to methods that are part of the known art and also because, for the purposes of this invention, it is relevant essentially for the function described earlier that it performs.

It is recalled that this function consists in connecting in their rotation, during a revolution, the shaft 76 bearing the cam 71 with the motor 56, in response to an inversion of the direction of rotation of the motor 56 from that which corresponds to the feeding, defined by the arrow 55, of the sheets 37 to the printing assembly 33; and also in disconnecting, at the end of this revolution, the shaft 76 from the motor 56.

The feeding mechanism 38 has, as already stated, the function of taking the sheets 37 from the ream 36 and of feeding them to the printing assembly 33, and, like the lifting mechanism 40, is suitable for being controlled by the main motor 56.

In particular, with reference to the FIGS. 2, 3, 4, 5 and 6, the feeding mechanism 38 comprises the central separating roller 57 already cited and provided for rotating in contact with an uppermost sheet 37 of the ream 36 for the purpose of separating it from the ream 36 and feeding it to the printing assembly 33 according to the direction defined by the arrow 55; a sliding-shoe 58 arranged adjacent to the separating roller 57 for cooperating with the latter in order to permit a correct separation one by one of the sheets 37 from the ream 36; a pair of driving rollers 62 mounted on a same shaft 69 at the sides of the separating roller 57 along the path of the sheets 37 to the printing assembly 33, but on the opposite side with respect to the separating roller 57; and a pair of output rollers 63 arranged on a same shaft downstream of the printing assembly 33 for accompanying the sheets 37, after they have been printed, to the outlet of the printer 20.

In particular the separating roller 57 is affixed centrally on a shaft 59, which extends parallel to a front edge of the flat bottom 53 and which is constantly in engagement with the motor 56 through a gear train 61, so that the separating roller 57 always rotates together with the main motor 56.

The two driving rollers 62 are also suitable for being commanded in rotation by the motor 56, in sync with the separating roller 57, through a gear train for the purpose of cooperating with the separating roller 57 for driving the sheets 37 from the ream 36 to the printing assembly 33.

A counter-rotating roller, not depicted in the drawings for simplicity's sake, may be coupled in a pressure relationship with each of the two driving rollers 62, so as to form two pairs of rollers which are in constant engagement and which are suitable for rotating to receive therebetween the sheets 37, for the purpose of feeding them.

Like the driving rollers 62, each of the two output rollers 63 may also be coupled in a pressure relationship with a corresponding counter-rotating roller so as to form two pairs of rollers suitable for receiving the sheets after printing and for controlling their feeding at the outlet of the printer 10 through the recess 39.

According to an essential characteristic of the invention, the printer 20 also comprises a feeding and guiding mechanism 81 (FIG. 2) which joins in movement the cassette 21 and the tray 34, both during the extraction of the cassette 21 from the casing 22 and when it is subsequently reinserted in the casing 22, so that, when the cassette 21 is extracted from the casing 22, the feeding tray 34 is automatically dragged by the print cassette 21 to move from a working position, indicated P1 in FIG. 3, wherein it is suitable for cooperating through its front portion 60 with the feeding mechanism 38 to permit a correct withdrawal of the sheets 37 from the ream 36, to an access position, indicated P2 in FIG. 4, wherein the feeding tray 34 has its front end 60 accessible from the outside in the area of the front side 23 of the printer 20, so as to allow the user to work on the feeding tray 34, for example to load therein a new ream 36 of sheets 37; and also so that when the cassette 21 is inserted again in the casing 22, the feeding tray 34 is dragged in the opposite direction to before by the print cassette 21 to return, from the access position P2 reached, to its working position P1, so as to be able to cooperate again with the feeding mechanism 38.

In particular, the feeding and guiding mechanism 81 comprises two bars 82 arranged to the sides of the feeding tray 34 and each having a first end 82*a* hinge-mounted on the structure 32 of the print cassette 21 through a pin 83, and second end 82*b* connected slidingly with the shell 70 of the feeding tray 34 through a slot-pin type coupling.

In greater detail, each end 82*b* of the bars 82 is provided with a slot 84 (FIGS. 3 and 10) which is coupled with a respective pin 86, which extends through the slot 84, so as to be able to slide each with respect to the other.

In particular, each pin 86 is integral with and protruding from a corresponding side wall 52 of the feeding tray 34.

The mechanism 81 also comprises two main ramps 87 and two horizontal slots 91 formed by the fixed structure 65 of the printer 20, two ratchet devices or pawls 88 arranged adjacent to the ends 82*b* of the two bars 82, and two auxiliary ramps 93 also formed by the fixed structure 65.

In particular, the two main ramps 87 are inclined with respect to the slide ways 18 between the mobile structure 32 of the print cassette 21 and the fixed structure 65 which define the direction of motion of the print cassette 21 along the casing 22. The two horizontal slots 91, on the other hand, extend parallel to the ways 18.

Furthermore, each of the two main ramps 87 is provided for cooperating in contact with a corresponding appendage 89 made on a side wall 52 of the feeding tray 34; whereas each of the two horizontal slots 91 forms a sliding coupling with a corresponding appendage 92 protruding from an external side of the rear seat 51 of the feeding tray 34 and extending through the slot 91.

Each of the two auxiliary ramps 93 is arranged for cooperating in contact with a corresponding one of the two ratchet devices 88.

Figure 10:
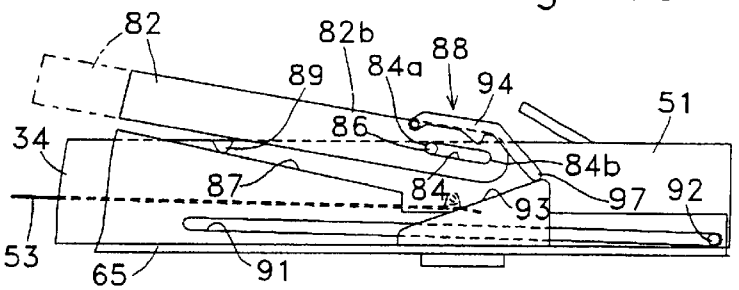
FIG. 10 is a front view of the area of FIG. 9.
Figure 9:
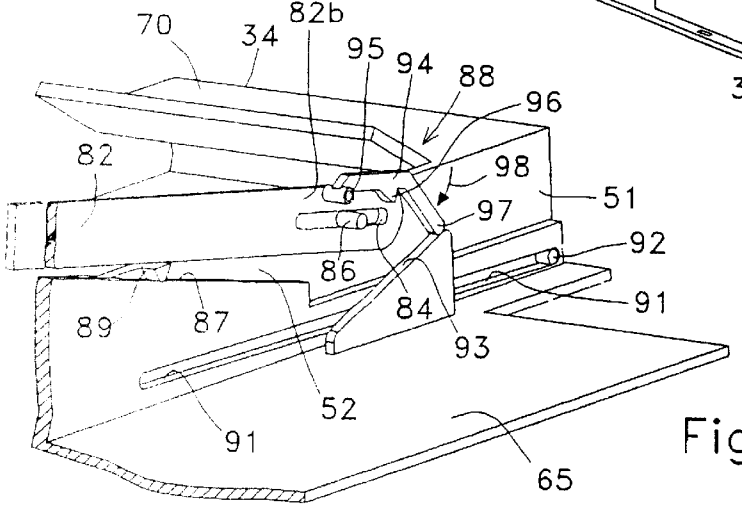
FIG. 9 is a sixth perspective view in enlarged scale of an area of the inner structure of the printer of FIG. 2 with a number of parts belonging to a mechanism for dragging and guiding a feeding tray of this printer.

In detail, as may be seen in FIGS. 9 and 10, each ratchet device 88 comprises a lever 94 of extended shape which has one end hinge-mounted on a corresponding bar 82 by means of a pin 95, and another end 97 cooperating in contact with a respective auxiliary ramp 93.

In addition each lever 94 is provided, in a central area between its two ends, with a tooth 96 suitable for cooperating with the pin 86 protruding from the side 52 and extending through the slot 84 of the bar 82.

The sliding couplings of the slot-pin type between the ends 82*b* of the two bars 82 and the feeding tray 34, the two ratchet devices 88, and the two auxiliary ramps 93, each arranged for cooperating with a corresponding lever 94 of the pawl 88, form in toto an over-travel device, the function of which is to leave the feeding tray 34 disconnected from the print cassette 21 at the start of the phase of extraction of the latter from the casing 22, for the purpose of freeing the feeding tray 34 from the printing assembly 33, and which as a result implies, at the end of the subsequent phase of insertion of the print cassette 21 in the casing 22, a final over-travel of the print cassette 21, with the feeding tray 34 motionless, as will be better described below.

Mode of Operation

The printer 20 described up to this point works as follows.

At the start of each feeding cycle of a sheet 37, the printer 20 is in the condition illustrated in FIG. 3, or also as in FIG. 2, with the main motor 56 stopped, with the print cassette 21 in a position P1' in which it is fully inserted in the casing 22, and with the feeding tray 34 already loaded with the ream 36 of sheets of paper 37 and in the position P1 in which it is suitable for cooperating with the feeding mechanism 38.

Under these conditions the front wall 30 of the cassette 21 is in abutment against the front edge of the casing 22, local to the front side 23 of the printer 20, so that the printing assembly 33 is fully housed inside the casing 22, and the shell 70 of the feeding tray 34 is aligned at the front, local to the end 60, with the printing assembly 33 and with the feeding mechanism 38.

In addition, the lever 72 is kept horizontal by the cam 71 so that the flat bottom 53, sitting on the lever 72, is also horizontal along the lower wall 50 of the feeding tray 34, with the ream 36 removed from the separating roller 57.

Finally, with reference to FIGS. 9 and 10, the two pins 86 are both arranged adjacent to the inner ends 84*a* of the two slots 84, i.e. to those ends disposed towards the centre of the respective bars 82, whereas the two pawls 88 have the respective levers 94 held raised off and unhooked from the pins 86 on account of their ends 97 being engaged with the top part of the auxiliary ramps 93.

In this arrangement, the printer 20, has for instance completed a printing cycle of a preceding sheet 37 taken from the feeding tray 34, and is ready to print a new sheet 37.

To this end the printer 20 is activated in a known way, via a control member which controls its operation, to perform a feeding cycle of the new sheet of paper 37 from the ream 36 housed in the tray 34, for the purpose of printing the desired information on this sheet.

To begin with, the motor 56 is commanded to rotate through a certain angle in the opposite direction to that corresponding to the feeding of the sheet 37 to the printing assembly 33.

In this way, by virtue of known expedients, the clutching group 74 determines the mechanical connection of the shaft 76, motionless in a state of non-engagement up to that time, with the motor 56. Then the motor 56 inverts its direction of rotation to rotate in the direction, also called primary, corresponding to the feeding of the sheet 37 to the printing assembly 33, so that the shaft 76, being connected with the motor 56, also starts rotating counter-clockwise as indicated by the arrow 73 of FIG. 8.

The result is that the cam 71 also rotates counter-clockwise allowing the lever 72 to rotate upwards, urged by the spring acting on the lever 72, and accordingly bring the ream 36 at the top into contact with the separating roller 57.

In this way, the sheet 37 arranged at the top of the ream 36 is captured, in cooperation with the sliding-shoe 58, by the separating roller 57 through the effect of rotation of the latter commanded by the motor 56 and of a direction intended to convey this uppermost sheet 37 to the printing assembly 33. Therefore the uppermost sheet 37 is disposed with a front edge between the separating roller 57 and the sliding-shoe 58.

When the ream 36 comes into contact with the separating roller 57, the cam 71 presents a slot along its profile so that the cam 71 disengages from the lever 72, in such a way that the latter acts on the flat bottom 53 so as to press the ream 36 directly against the separating roller 57. In the meantime the cam 71 continues to rotate counter-clockwise, so that, after a certain time period corresponding to the slot mentioned above, it engages again with the lever 72 to rotate it downwards.

In this way, the flat bottom 53, resting though gravity on the tip of the lever 72, also rotates downwards, so that the ream 36 retracts from the separating roller 57 leaving in engagement with the latter-named the uppermost sheet 37.

When the cam 71 has completed a rotation of approximately one revolution, and therefore both the lever 72 and the ream 36 are horizontal, the mono-directional clutching group 74, by virtue of known expedients, disconnects from the motor 56 the shaft 76, which is thus in a state of non-engagement. Correspondingly the cam 71 also stops.

Meanwhile the motor 56 continues rotating to command the feeding mechanism 38 so as to feed the sheet 37 along its full extent in front of the printhead 41, to be printed.

A succession of phases similar to that described above takes place for the feeding and printing of each sheet.

When, with the printer 20 idle and arranged as in FIG. 3, action needs to be taken to perform the customary maintenance operations, such as for example substitution of the used ink jet printhead with a full printhead, or the loading of a new ream 36 in the tray 34, the user of the printer 20 extracts, using the handle 29, the cassette 21 from the casing 22 by sliding it outwards on the ways provided in the fixed structure 65, so that the print cassette 21 moves from the position P1' to the position P2' indicated in FIG. 4.

In particular, during a first phase of the movement of extraction of the print cassette 21 and as depicted with the dot-and-dash line in FIGS. 9 and 10, the two bars 82 slide with respect to the pins 86 until the outer ends 84*b* of the slots 84, i.e. the ends arranged outermost along the respective bars 82, come into engagement with the pins 86.

Accordingly, during this first phase, the print cassette 21 does not drag the feeding tray 34, which remains in its initial working position P1, so that the separating roller 57 of the feeding mechanism 38, being borne by the print cassette 21, moves forward with respect to the front end 60 of the tray 34.

In this way the separating roller 57 frees the front end 60 of the feeding tray 34, which can thus subsequently rotate upwards without meeting opposition, whereas the print cassette 21 continues in its motion of extraction from the casing 22.

Again during this first phase, with the feeding tray 34 still motionless, the two levers 94 of the two pawls 88 rotate downwards, as indicated by the arrow 98, on account of the sliding of the levers 94 along the secondary ramps 93 and arrange themselves with the respective teeth 96 in front of the pins 86.

Upon completion of this first phase, when the two slots 84 finally mesh through their outermost ends with the two pins 86, the print cassette 21 starts to drag by means of the two bars 82 the feeding tray 34, which thus moves jointly with the print cassette 21.

This joint movement continues throughout the remaining part of the extraction stroke of the print cassette 21, until the latter reaches its final position P2', wherein the printing assembly 33 is fully out of the casing 22 and thus easily accessible to the operator.

At the same time, while the print cassette 21 is being extracted from the casing 22, the two main ramps 87 and the two slots 91, engaging respectively with the two appendages 89 and with the two appendages 92, produce a complex motion of the feeding tray 34, consisting of a sliding motion towards the outside of the casing 22 and a front rotation upwards with respect to the print cassette 21.

In this way, the feeding tray 34, at the end of the extraction stroke of the print cassette 21, goes into the access position P2, wherein the feeding tray 34 has its front portion 60 raised with respect to the printing assembly 33 and additionally accessible to the operator in the area of the front side 23.

Therefore in this access position P2, the operator can effect the required operations on the feeding tray 34, for instance loading a new ream therein, or substituting the current one.

Upon completion of the maintenance operations on the printing assembly and/or feeding tray 34, the printing cassette 21 is again reinserted in the casing 22, and thus pushed inside the latter in the opposite direction to before by way of the handle 29. As soon as the print cassette 21 inverts its motion of sliding with respect to the casing 22 to go back to the position P1', the two teeth 96 of the levers 94 come into engagement with the corresponding pins 86, so that the feeding tray 34 is immediately connected through the bars 82 with the print cassette 21 and is dragged by the latter inside the casing 22.

In this way the ramps 87 and the slots 91, by cooperating with the respective appendages 89 and 92, guide the feeding tray 34 so that it effects a complex movement the exact inverse of before, wherein the feeding tray 34 returns fully inside the casing 22, and at the same time rotates frontally downwards to dispose itself again horizontal with the front portion 60 beside the print cassette 21.

Shortly before the end of the reinsertion stroke of the print cassette 21 the two levers 94 come into contact through the respective ends 97 with the two auxiliary ramps 93, as a result of which, by sliding along the latter, the two levers 94 rotate upwards thereby disengaging the teeth 96 from the pins 86.

In this way the feeding tray 34, as it is no longer dragged by the print cassette 21, stops again precisely in the position P1 that it had before at the start of the motion of extraction of the print cassette 21. The latter, on the other hand, continues its motion of reinsertion in the casing 22 until it reaches the previous position P1', effecting an over-travel corresponding to the longitudinal extension of each slot 84, so that the two innermost ends of the slots 84 are again adjacent to the pins 86.

In this configuration, the printer 20 is again ready to receive a new print command so as to take another sheet 37 from the feeding tray 34 and print it with the printing assembly 33 through the sequence described above.

In short, without prejudice to the principle of this invention, the construction details and embodiments may be amply varied with respect to what has been described and illustrated, without departing from the scope of the invention.

For example, the mechanism 81 described thus far, typically and exclusively mechanical, adapted for jointly linking in movement the print cassette 21 and the feeding tray 34, may be substituted by means which, though having a different structure from the mechanism described, are however functionally equivalent to it, and therefore intended to perform the same function of moving the feeding tray in order to make it accessible from the outside, in correspondence with the front side of the printer, each time the print cassette is extracted from the casing.

More specifically, the alternative means to the mechanism may also comprise electric parts, such as a motor, or an electric actuator associated with the feeding tray for moving it as described above.

In addition, the operations of extracting and inserting the print cassette respectively from and in the casing may also not be of the manual type, and be, at least partially, aided by service means of the electromechanical type suitable for actuation by a signal controlled by the user and such as to eliminate most of efforts required of the latter.

For example, these means may comprise a motor connected to the print cassette and actuated by a push button, or alternatively by a signal transmitted from a remote control, to command the extraction of the print cassette from the casing, and also its subsequent reinsertion in the casing.

What we claim is:

1. Printer operable from the front and suitable for being stacked with other equipment, comprising:

an outer casing;

a front side;

a print cassette bearing a printing assembly, said print cassette being suitable for extraction from and insertion in said casing through said front side for performing maintenance operations on said printer;

a feeding tray accommodated in said casing for holding a plurality of sheets, said feeding tray being, when said print cassette is inserted in said casing, in a working position inside said casing wherein said feeding tray is suitable for cooperating through a front portion with said print cassette for feeding the sheets held in said feeding tray to said printing assembly; and moving and guiding means for moving and guiding said feeding tray jointly with said print cassette during its extraction from and insertion in said casing, in such a way that, when said print cassette is extracted from said casing, said feeding tray automatically moves from said working position to an access position, in which said feeding tray has said front portion accessible from the outside in the area of said front side; and in such a way furthermore that, when said print cassette is subsequently reinserted in said casing, said feeding tray goes back again into said working position.

2. Printer according to claim 1 wherein, when said feeding tray is in said access position, said front portion is detached from said print cassette.

3. Printer according to claim 2 wherein, when said feeding tray is in said access position, said front portion is raised with respect to said print cassette.

4. Printer according to claim 1, wherein said moving and guiding means are made of a feeding and guiding mechanism which mechanically joins said print cassette to said feeding tray, so that said feeding tray is dragged into movement by said print cassette when the latter is extracted and inserted with respect to said casing.

5. Printer according to claim 4, also comprising a fixed structure whereupon said casing is affixed, wherein said feeding and guiding mechanism comprises:

at least one joining member for joining said print cassette to said feeding tray; and a set of guides and of corresponding guide elements suitable for cooperating reciprocally in contact, said guides and said corresponding guide elements being made respectively on said fixed structure and on said feeding tray;

wherein, during the extraction movement of said print cassette from said casing, said joining member drags towards the outside said feeding tray, and at the same time said guides cooperate in contact with the corresponding guide elements made on said feeding tray to produce a rotation of the latter upwards in relation to said print cassette, so that, when said print cassette reaches its end of travel position at the end of the extraction movement from said casing, said feeding tray is disposed with a front portion raised with respect to said printing assembly and accessible from the outside.

6. Printer according to claim 5, wherein said print cassette is constrained to slide, during the motion of extraction and reinsertion with respect to said casing, on slide ways made on said fixed structure and extending substantially parallel to said casing, wherein said joining member comprises at least one bar hinge-mounted at the ends on said print cassette and on said feeding tray; in that said ways made on said fixed structure comprise at least one ramp inclining with respect to said slide ways, and a slot substantially parallel to said slide ways; and in that said guide elements made on said feeding tray comprise appendages protruding with respect to a shell of said feeding tray.

7. Printer according to claim 5, wherein said print cassette is arranged in a closed position when it is fully inserted in said casing with said feeding tray in said working position, wherein said feeding and guiding mechanism is associated with an over-travel device which, in the initial phase of the extraction movement of said print cassette from said casing, ensures that said feeding tray is dragged into movement by said print cassette only after the latter has travelled, starting from said closed position, a determined distance such as to free said feeding tray from said print cassette, so that said feeding tray remains initially motionless and is dragged into movement by said print cassette with a certain delay corresponding to said distance; and which, vice versa, in the final phase of the movement of reinsertion, in the opposite direction to before, of said print cassette in said casing, ensures that said feeding tray disconnects and accordingly is no longer dragged by said print cassette, when the latter is again in position at said determined distance from said closed position, so that said feeding tray stops whereas said print cassette continues to move along an over-travel corresponding to said determined distance in order to reach again said closed position.

8. Printer according to claim 7, in that dependent upon claim 6, wherein said over-travel device comprises:

at least one coupling of a slot-pin type consisting of a slot made on an end of said bar and a corresponding pin protruding from said feeding tray and sliding along said slot, at least one pawl having a lever hinge-mounted on said bar in an area adjacent to said slot-pin type coupling, said lever being provided with a tooth suitable for cooperating with said pin, and an auxiliary ramp arranged for cooperating in contact with said lever to control its rotation, wherein, when said print cassette is initially extracted from said casing, said slot slides with respect to said pin until the latter enters engagement with an end of said slot so as to subsequently join in motion said feeding tray with said print cassette, and in addition said auxiliary ramp commands a rotation of said lever such as to place said tooth in front of said pin;

wherein, as soon as said print cassette is initially made move in the opposite direction to before to be reinserted in said casing, said tooth engages with said pin for dragging said feeding tray jointly with said print cassette; and wherein, at the end of the motion of reinsertion of said print cassette, said lever again comes into engagement with said auxiliary ramp to rotate and disengage said tooth from said pin, so that said feeding tray stops, whereas said print cassette continues to travel over a distance corresponding to the length of said slot until said print cassette is fully inserted in said casing.

9. Printer according to claim 5, wherein said joining member consists of two rods which join said print cassette to two lateral sides of said feeding tray, and which extend substantially parallel to said sides.

10. Printer according to claim 1, wherein said printer has a substantially parallelepiped external shape conferred on it by said casing, wherein the sides of said printer, with the exception of said front side and of a rear side opposite said front side, are substantially flat and free of members for manually controlling the printer and connecting it to other equipment, and of areas through which the user has to operate in order to intervene on the printer.

11. Printer according to claim 10, wherein a cable for powering and interconnecting with the outside said printer are arranged on said rear side.

12. Printer according to claim 1, wherein said printing assembly comprises a printhead of the ink jet type.

13. Printer according to claim 1, wherein in said access position said feeding tray has said front portion protruding with respect to said casing.

14. Printer according to claim 1, wherein said print cassette may be extracted and inserted respectively from and into said casing in a fully manual way.

15. Printer according to claim 1, further comprising:

a feeding mechanism for feeding the sheets from said feeding tray to said printing assembly, said feeding mechanism being supported by said print cassette and having a separating roller;

a lifting mechanism associated with said feeding tray; and a motor suitable for commanding both said lifting mechanism and said feeding mechanism, said motor being provided for rotating according to a main direction of rotation corresponding to the feeding of the sheets to said printing assembly, wherein said lifting mechanism is initially disconnected from said motor and is suitable for connecting to said motor in response to a rotation of the latter opposite to said main direction of rotation, wherein said lifting mechanism, when said motor subsequently inverts its rotation and returns to rotating according to said main direction of rotation, operates under the control of said motor in order to lift, during a feeding cycle, a ream of sheets accommodated in said feeding tray so as to bring an uppermost sheet of said ream into contact with said separating roller; and wherein said lifting mechanism, at the end of said feeding cycle, disconnects from said motor, so that said lifting mechanism remains idle, whereas said motor continues to rotate according to said main direction of rotation to feed through said feeding mechanism said uppermost sheet to the printing assembly.

16. Printer according to claim 15, wherein said lifting mechanism comprises a clutching group being able both to connect said lifting mechanism to said motor in response to a rotation of the latter opposite said main direction of rotation, and to disconnect said lifting mechanism from said motor at the end of said feeding cycle.

17. Printer according to claim 16, wherein said feeding tray comprises an outer shell and a bottom hinge-mounted on said shell for supporting by the bottom the ream accommodated in said feeding tray, wherein said lifting mechanism further comprises a cam, which is connected to said motor through said clutching group, and a lever cooperating in contact with said bottom, wherein said cam is suitable for commanding through said lever the rotation of said bottom to bring said uppermost sheet into engagement with said separating roller.

18. Printer according to claim 1, further comprising service means of the electromechanical type to servo command the movement of extraction and/or of reinsertion of said print cassette, and/or the movement of said feeding tray with respect to said casing, so as to eliminate or at least reduce the effort needed by the user to move jointly said print cassette and said feeding tray.

19. Printer according to claim 18, wherein said service means are suitable for actuation by a signal transmitted by the user by means of a remote control device.

* * * * *